United States Patent [19]

Barras

[11] 3,936,978

[45] Feb. 10, 1976

[54] WINDOW HAVING A BELLOWS-TYPE OPENING MOVEMENT AND PERMITTING COMPLETE REVERSAL OF THE WINDOW-LEAF

[75] Inventor: Gerard Barras, Aubervilliers, France

[73] Assignee: Agence Nationale de Valorisation de la Recherche (ANVAR), Neuilly-sur-Seine, France

[22] Filed: June 17, 1974

[21] Appl. No.: 479,787

[30] Foreign Application Priority Data

June 22, 1973 France ..... 73.22974
Feb. 26, 1974 France ..... 74.06505

[52] U.S. Cl. ..... 49/252; 49/249
[51] Int. Cl.² ..... E05D 15/42
[58] Field of Search ..... 49/246, 248, 249, 250, 49/252, 386, 322, 449

[56] References Cited

UNITED STATES PATENTS

| | | | |
|---|---|---|---|
| 2,044,258 | 6/1936 | Reynaud | 49/252 |
| 3,101,135 | 8/1963 | Neal et al. | 49/248 |

FOREIGN PATENTS OR APPLICATIONS

| | | | |
|---|---|---|---|
| 1,328,530 | 4/1962 | France | 49/252 |
| 1,326,220 | 6/1962 | France | 49/252 |
| 606,155 | 3/1957 | Italy | 49/249 |
| 1,040,414 | 10/1958 | Germany | 49/246 |

*Primary Examiner*—Kenneth Downey
*Attorney, Agent, or Firm*—Ernest F. Marmorek

[57] ABSTRACT

The movable window-leaf has an axis of pivotal motion parallel to one side and displaceable in translational motion in a direction parallel to itself, two identical arms being pivotally attached at one end to the two sides located at right angles to said axis and at the other end to the corners of the fixed window-casing. The length of the two arms is at least equal to one-half the length of the sides of the window-casing located at right angles to the pivotal axis so as to permit complete reversal of the window-leaf about the two points of pivotal attachment of the arm to the leaf.

11 Claims, 16 Drawing Figures

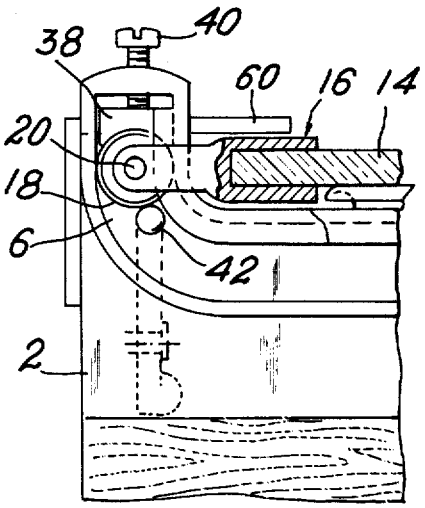
FIG. 2
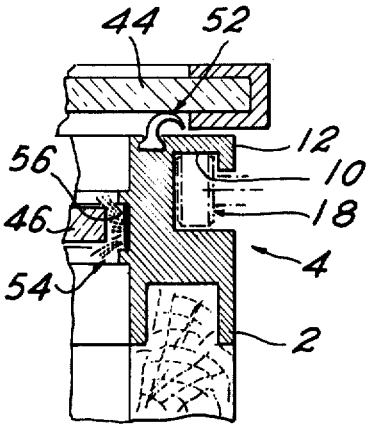
FIG. 3
FIG. 4
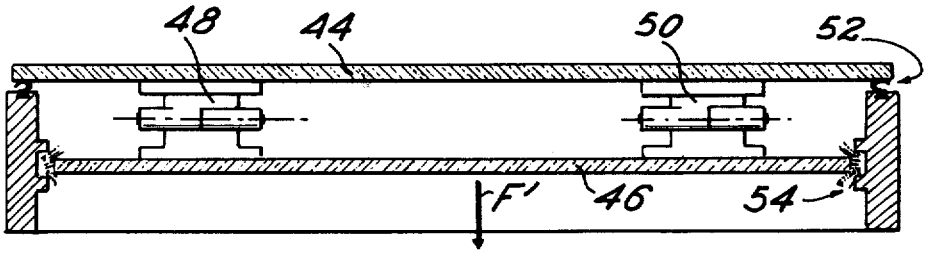

WINDOW HAVING A BELLOWS-TYPE OPENING MOVEMENT AND PERMITTING COMPLETE REVERSAL OF THE WINDOW-LEAF

This invention relates to a bellows-opening window which permits complete reversal of the window-leaf.

A window is referred-to as having a bellows-type opening action if the moving portion of the window which comprises the glazed portion is capable of opening by pivotal motion of the moving assembly about an axis which coincides with one of the sides of the fixed window casing. The opening action is of the so-called external type if the window-leaf is intended to move outside the building-wall in which the window is fitted, this type of window being employed especially for roof-lights.

By "fixed window-casing" is meant both a stationary frame which is rigidly fixed to the masonry and made of any suitable material and a frame formed by the concrete back-band of the building structure.

One of the important problems involved in the use of a window of this type arises at the time of cleaning of the outer face of the glass pane. This problem is particularly acute in the case of an external-opening window since the outer face of the glass panel is practically inaccessible in this case.

This result can already be obtained by means of existing windows of the roof-light type and among these can be mentioned:

a roof-light in which the pivotal axis of the window-leaf is located at the mid-length of the window-casing and therefore also of the leaf. This solution has a major drawback in that it permits the penetration of water and snow when the window is open in addition to the fact that the leaf projects inwards;

another type of window has two frames pivotally connected to each other by means of pivot-pins located at the mid-length and permitting of reversal of the glazed portion which is fixed on one of them for the purpose of cleaning the outer face; these two frames are normally employed for a bellows-type opening when they are attached to each other, this opening being formed by means of a pin which is placed on one side of one of the frames and permits of articulation with respect to the fixed window-casing. This solution multiples sealing problems by two and therefore increases the cost of manufacture.

The precise aim of the present invention is to provide a window of the bellows-opening type which overcomes the disadvantages mentioned in the foregoing insofar as it also permits complete reversal of the window-pane by means of a single leaf which remains at the exterior during the entire period of reversal.

The window of the bellows-opening type which permits complete reversal of the window-leaf essentially comprises a movable leaf, said leaf being provided along one side with means for forming an axis of pivotal motion of said leaf with respect to the fixed window-casing, said axis being parallel to said side and being constrained to move in a direction parallel to itself, said window-leaf being further provided on each of its two sides which are located at right angles to the axis of pivotal motion with an arm such that one end of said arm is pivotally mounted on the side of the window-leaf at a point of articulation which permits complete reversal of said leaf and the other end of said arm is pivotally attached to one of the corners of the fixed window-casing, the straight lines which join said points of articulation respectively to the window-leaf and to the window-casing being parallel to the axis of pivotal motion whilst the straight line which joins the points of articulation of the articulated arm with respect to the window-casing coincides with the axis of pivotal motion of the window-leaf when said leaf is in the closed position, the two arms being identical and having a length at least equal to one-half the length of the sides of the window-casing at right angles to the axis of pivotal motion so that a movement of complete reversal of the window-leaf takes place about the points of articulation of said arms on said leaf.

In a preferred embodiment of the invention, the means for forming an axis of pivotal motion are constituted by rollers, each roller being coupled to one of the two consecutive corners of the window-leaf, both rollers being so arranged as to have a common axis which coincides with the axis of pivotal motion to be formed and by two grooves extending over at least the full length of the sides of the window-casing which are at right angles to the common axis of the two rollers, said rollers being constrained to move within said grooves.

In one alternative embodiment, the end of each arm which is pivotally attached to the window-casing is rigidly fixed to one end of a straight rod which traverses said window-casing through two bores, the longitudinal axis of said rod being intended to constitute the axis of pivotal motion of said arms with respect to said window-casing, said rod being fitted on the one hand with an elastic restoring device so arranged that one end of said device is attached to the window-casing and the other end thereof is attached to said rod and on the other hand with a member for displacing said rod in rotation about its longitudinal axis.

A clearer understanding of the invention will in any case be obtained from the following description of two embodiments of the invention which are given by way of example and not in any sense by way of limitation, reference being made to the accompanying drawings, wherein:

FIG. 2 is a detail view of FIG. 1 showing one form of construction of the movable axis of rotation;

FIG. 3 is a detailed fragmentary sectional view of FIG. 1 taken along the plane A—A;

FIG. 4 is a sectional view taken along the plane B—B of FIG. 1;

Figure 5A:
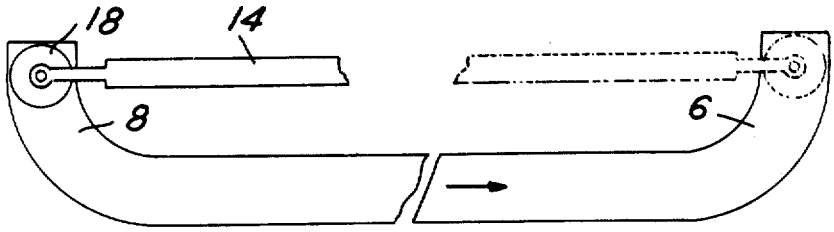
Figure 5B:
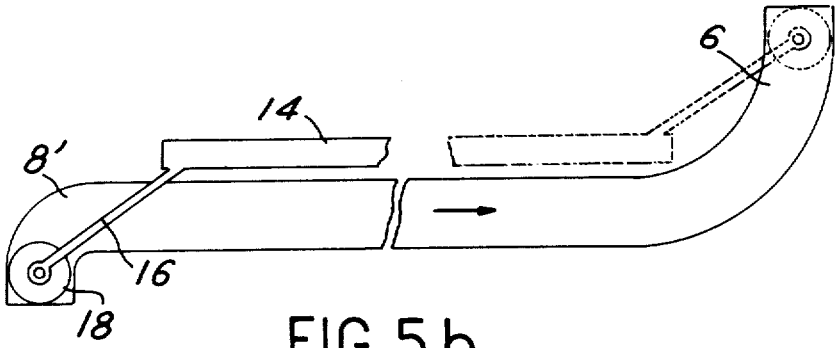
Figure 5C:
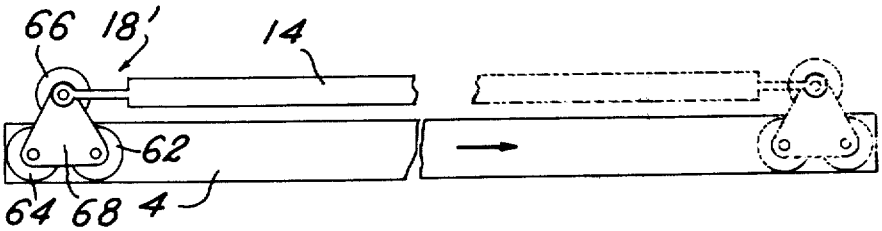
Figure 6:
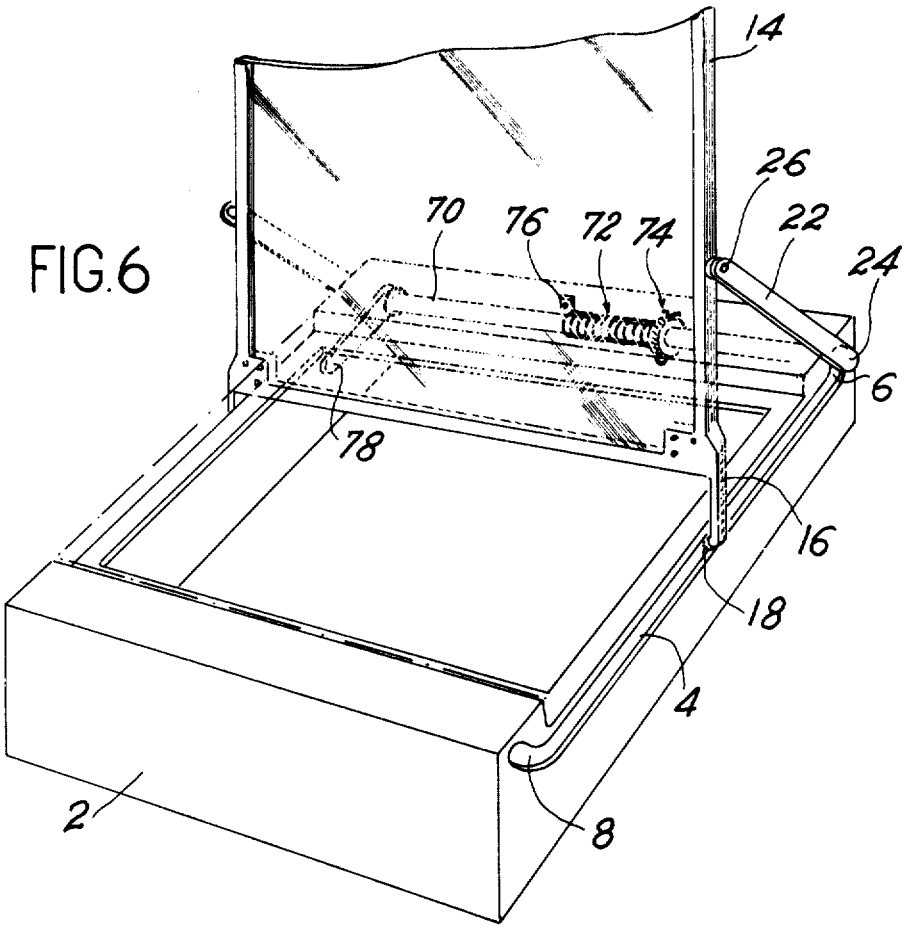
Figure 8:
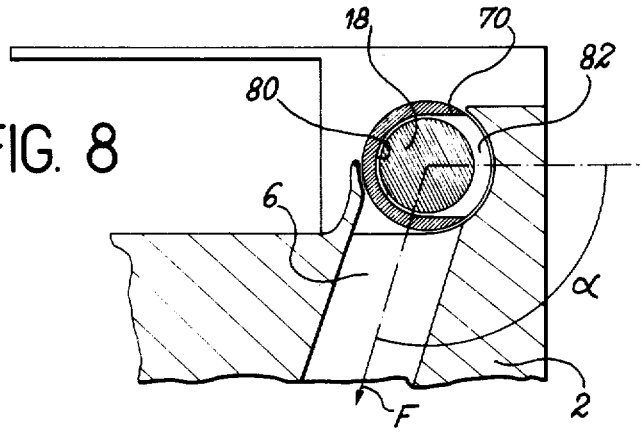
Figure 7:
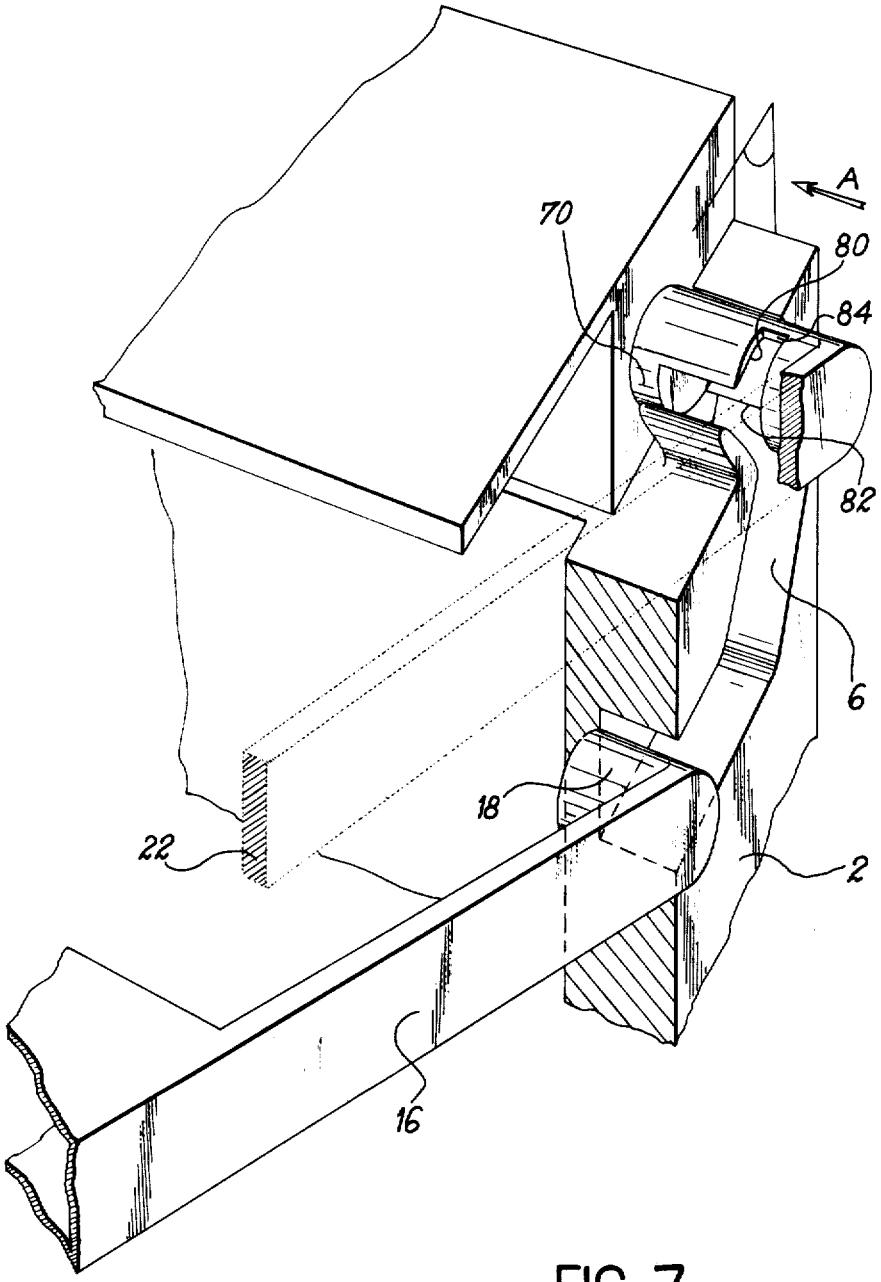

FIGS. 5*a*, 5*b* and 5*c* show alternative forms of construction of the roller and of the guide forming the movable axis of rotation;

FIG. 6 is a view in perspective showing the second embodiment of the window;

FIG. 7 is a perspective view showing a detail of FIG. 6;

FIG. 8 is a sectional view taken along the plane A—A of FIG. 7;

FIGS. 9*a* to 9*f* are diagrams illustrating the operation of the window. The use of terms up and down, or above and below, are intended to facilitate comprehension but not meant in any limiting sense. They referred to the directions shown in the Figs. (as drawn) as up or down.

Figure 1:
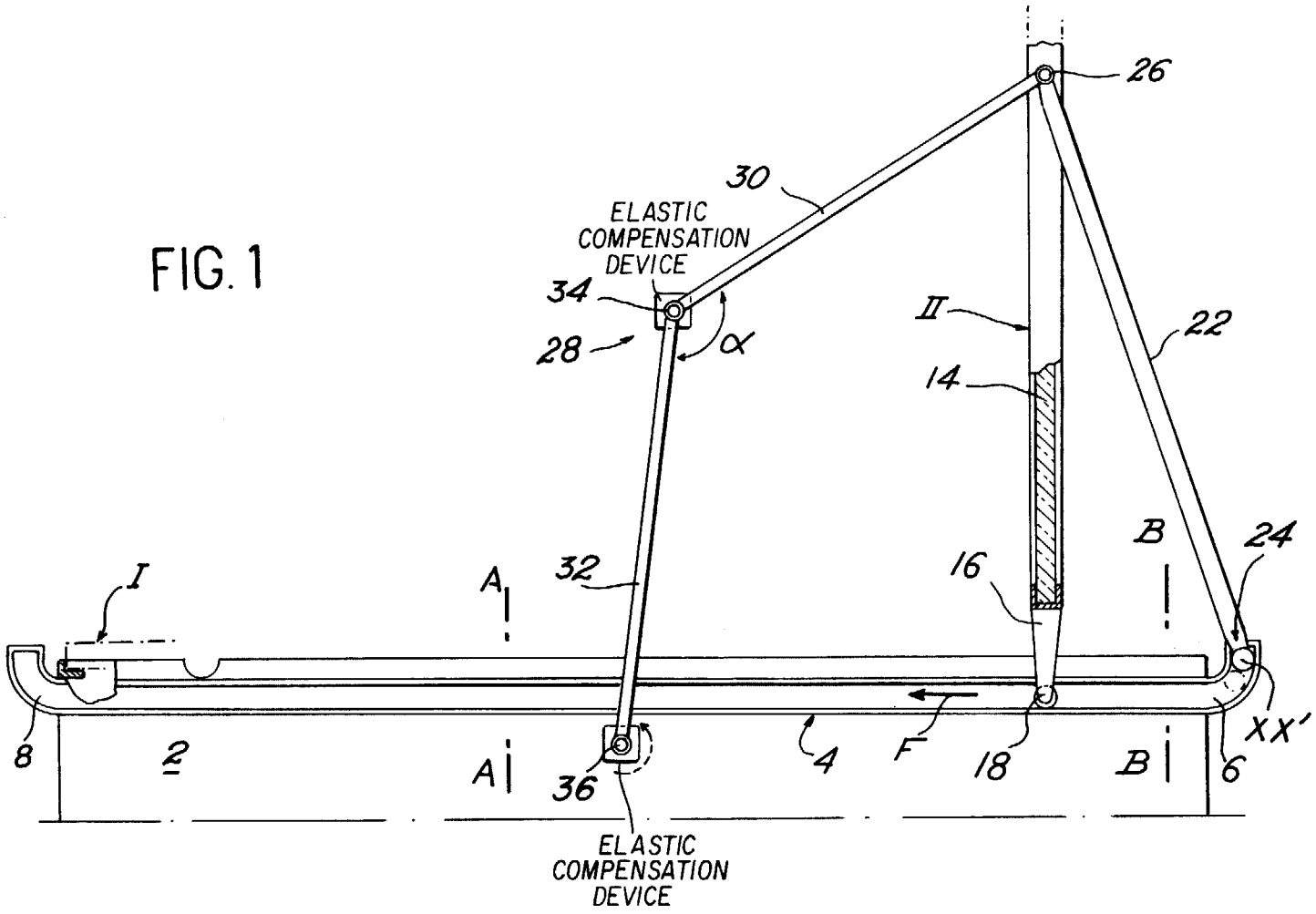
FIG. 1 is a side view showing the complete window in the first embodiment.

There is shown diagrammatically in the side view of FIG. 1 a first embodiment of the window according to the invention. Said window comprises a rectangular casing 2 which is stationarily fixed to the roof structure and can be either vertical, horizontal or inclined according to the type of service which is contemplated. The window can be made of any materials such as wood, aluminum, plastic and so forth. It should also be understood that the term "rectangular" is intended to include square window-casings.

At the time of normal operation, the window opens in a normal bellows-type movement about the axis X-X' which is parallel to one of the sides of the fixed window-casing 2 (namely the side at right angles to the plane of FIG. 1). The window-casing 2 is provided along each side at right angles to the axis X-X' with a guide 4 which terminates at each end in a curved portion 6 and 8 respectively. The guide 4 as represented in greater detail in FIG. 3 is constituted, for example, by a metallic sectional member having a groove 10 which is formed along the entire length of this latter and is open towards the exterior of the window-casing 2. The open face of the groove 10 is partly closed by a flange 12. The metallic sectional member is rigidly fixed to the window-casing 2 by any known means such as forcible interengagement as shown in FIG. 3.

The window further comprises a rectangular leaf 14 which constitutes the transparent portion of the window. The window-leaf 14 is fitted at the two corners nearest the axis X-X' with a member 16, one end of which is secured to the window-leaf and the other end of which is rigidly fixed to a roller 18. The roller 18 is mounted to rotate freely on the spindle 20 which is rigidly fixed to the member 16. Said roller 18 is capable of moving freely within the groove 10 of the guide 4. The two rollers 18 thus define an axis of rotation for the window-leaf 14; this movable axis of rotation is capable of displacement along the entire length of the window-casing while remaining parallel to the axis X-X'. The window-leaf 14 is fitted with a rigid arm 22 on each side which is located at right angles to the axis X-X'. The arm 22 is pivotally mounted on the one hand on the pin 24 which is rigidly fixed to the top portion 6 of the guide 4 (the axis of said pivot-pin coincides with the axis X-X') and is pivotally mounted on the other hand on the pin 26 which is rigidly fixed to the window-leaf 14 and located in the vicinity of the mid-point of the side of said leaf.

The window leaf can be provided on each side with a second arm or supporting arm 28 consisting of two rigid rods 30 and 32 which are articulated at the point 34. Said supporting arm is pivoted to the window-leaf by the pin 26 and to the window-casing by the pin 36 which is located slightly below the guide 4. An elastic compensation device may also be provided at point 34 and at the pin 36. The window is further provided with a stop 38 (as shown in FIG. 2) which is placed at the top of the curved portion 6 of the guide 4 and rigidly fixed to said guide by means of a screw 40. The portion 6 of the guide 4 is provided with a stud 42 and this latter is retractable by means of a mechanism which is not shown in the figure. When the stud 42 projects within the groove 10, it arrests the roller 18 in the position shown in FIG. 2.

The rods 30 and 32 have a sufficient length to form an angle $\alpha$ of less than 180° in all positions of the window-leaf. Moreover, when the window is closed (position I of the window-leaf), the two rods tend to apply the movable leaf 14 against the fixed casing 2.

The window-leaf 14 can consist of a single or double glass pane unit with or without a frame. The leaf can also have two independent glass panes 44 and 46 as shown in FIGS. 3 and 4. These two panes are joined together by means of two hinges 48 and 50 and by means of a catch (not shown). Leak-tightness between the top pane 44 and the window-casing 2 is obtained, for example, by means of a sealing strip 52 which is fixed around the entire periphery of the window-casing 2 at the top portion of this latter. Leak-tightness between the bottom pane 46 and the window-casing 2 is obtained by means of a flexible sealing strip 54 which is fixed within a channel 56 formed in the internal face of the window-casing 2. Said sealing strip 54 permits the possibility of lowering the window-pane 46 in the direction of the arrow F' by pivotal motion about the hinges 48 and 50. Furthermore, it is possible to add a locking-bolt which is secured to the fixed casing 2 and serves to apply the window-leaf against said casing.

In FIGS. 5*a*, 5*b* and 5*c*, there are shown different forms of construction of the guides 4. The form shown in FIG. 5*a* corresponds to the guide which has already been described. In FIG. 5*b*, the curved portion 8' (corresponding to the curved portion 8 of FIG. 1) is directed downwards. In this case the members 16' which serve to attach the rollers 18 are elbowed. In FIG. 5*c*, the guide 4 is rectilinear. Each roller 18' is constituted by two runner-wheels 62, 64 and a spindle 66 which are connected together by means of a plate 68. In this case the member 16 is rigidly fixed to the top spindle 66, the runner-wheels 62 and 64 being engaged in the guide 4. In each of these figures, the right-hand half-view shows the roller in its initial position and the left-hand half-view shows the same roller after the reversal of the window-leaf has taken place.

It must be understood that the system consisting of the rollers 18 and the guide 4 has been described solely by way of example without any limitation being implied. In consequence, it would not constitute a departure from the scope of the invention to provide any system which makes it possible to form an axis of pivotal motion of the window-leaf with respect to the fixed casing, said axis being capable of translational motion in a direction parallel to the plane of contact between the casing and the leaf when this latter is closed. In particular, consideration could be given to other methods for guiding said axis. For example, each roller 18 could be attached to a continuous chain stretched between two pinions placed at each end of the window-casing, the movements of displacement of the chain being such as to cause the translation motion of the corresponding roller and therefore of the pivotal axis. Similarly, the supporting arms 28 are not essential to the constructional design of the window and serve only to ensure easier and more reliable operation of the window-leaf.

FIG. 6 is a diagrammatic view in perspective showing the complete window assembly in accordance with the alternative embodiment. In this figure, the same reference numerals have again been employed to designate parts which are common to FIG. 1. The fixed rectangular window-casing 2 is provided on each of the sides which are perpendicular to the pivotal axis of the window-leaf with a groove 4 terminating in two curved portions 6 and 8 respectively. The groove 4 can advantageously be formed in the manner which has been described earlier.

The window further comprises a movable rectangular leaf 14 which constitutes the transparent portion of the window. The window-leaf 14 is fitted at each of its two bottom corners with a member 16, one end of said member being fixed on the window-leaf and the other end of said member being coupled to a roller 18. The roller 18 is constrained to move in translational motion within the groove 4. On each of the sides which are fitted with the members 16 and rollers 18, the window-leaf 14 is provided with an arm 22 which is pivoted at one end to the leaf 14 by the pin 26 and at the other end to the fixed casing 2 at the point 24. In accordance with the improvement which forms the subject of the invention, the points of articulation 24 of the arms 22 with respect to the fixed casing are essentially constituted by a straight rod 70 which traverses the casing through two bores not shown in the figure, said rod being rigidly fixed at each end to one of the arms 22 at the point 24. Thus the movements of rotation of the rod 70 result in a rotation of the arms 22 about the axis of the rod 70. The rod 70 is fitted with an elastic restoring system constituted for example by a spring 72 which is placed around the rod 70. One end of the spring 72 is secured to the rod 70 by means of the collar 74. The other end of the spring 72 is secured to the window-casing 2 by means of the member 76. In addition, the rod 70 is fitted with an operating lever 78; said lever may be replaced by a toothed pinion which is mounted on the rod 70 and disposed in meshing engagement with a worm.

The articulation of the arm 22 on the fixed window-casing 2 is shown in greater detail in FIG. 7. As explained earlier, in order to permit a true bellows-type opening action in addition to complete reversal of the window-leaf, the common axis of the rollers 18 must coincide with the axis of pivotal motion of the window-leaf with respect to the window-casing or in other words must coincide with the axis of the rod 70 when the window-leaf is in the closed position of rest.

This result is achieved by forming within each end portion of the rod 70, that is to say substantially at the point 24 at which the arms 22 are fixed on the rod 70, a recess 80 having a length and a diameter which are sufficient to permit the introduction within said recess of the roller 18 and of the lower end of the arm 16. Said recess therefore forms an extension of the curved portion 6 of the groove 4. It will be understood that the recess 80 is provided with an opening 82 which is intended to establish a communication between the recess 80 proper and the portion of groove 6 and permits the transfer of the roller 18 from the groove 6 to the recess 80. The opening 82 has an extension in the form of a groove 84 into which the lower end of the arm 16 is permitted to pass when the roller 18 is locked in position within the recess 80.

In order to permit opening in a normal bellows-type movement, each recess 80 is fitted with a retractable and controllable locking device (not shown in FIG. 2) which serves to lock the roller 18 in position within the recess 80 at the time of an opening movement. On the contrary, when it is desired to obtain the reversal of the window-leaf, the locking device is withdrawn, thereby permitting the displacement of the roller 18 within the groove 6 and then within the groove 4.

In the alternative form of construction shown in FIG. 8, the retractable locking-bolt can be dispensed with in order to maintain each roller 18 in position at the time of opening in a bellows movement.

In the state of rest (that is to say when the window is closed), the opening 82 of the recess 80 does not open into the groove 6; on the contrary, said opening is closed-off by the top portion 86 of the fixed window-casing 2. The roller 18 is thus locked in position within the recess 80. In order to lift the window-leaf, the operating lever 78 is actuated and this causes the rotation of the rod 70. The roller 18 remains imprisoned within the recess 80 until the opening 82 comes opposite to the groove 6. This position is represented by the arrow F in a chain-dotted line. The window can thus be opened in a bellows-type movement through an angle $\alpha$. When the operating lever is in position indicated in the figure by the arrow F, the roller 18 escapes from the recess 80 and passes into the groove 6, then into the groove 4. When the window-leaf has passes beyond the vertical position (namely the position of the leaf shown in FIG. 6), the direction of rotation of the rod 70 is reversed, thereby initiating the reversal of the window-leaf 14 as indicated earlier.

With reference to FIGS. 9*a* to 9*f*, there will now be described the movement of the window when it is desired to obtain complete reversal of the window-leaf, that is to say when it is found necessary to clean the outer face of the window-pane.

Figure 9A:
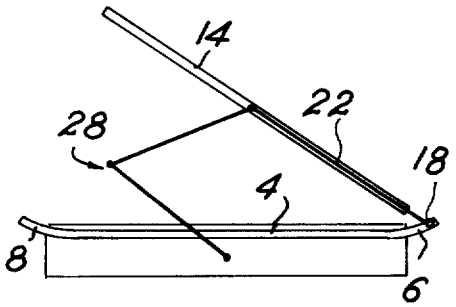
Figure 9B:
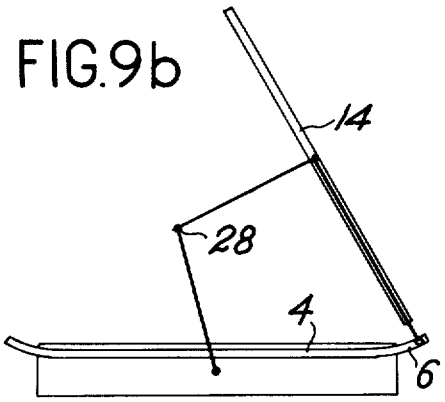
Figure 9C:
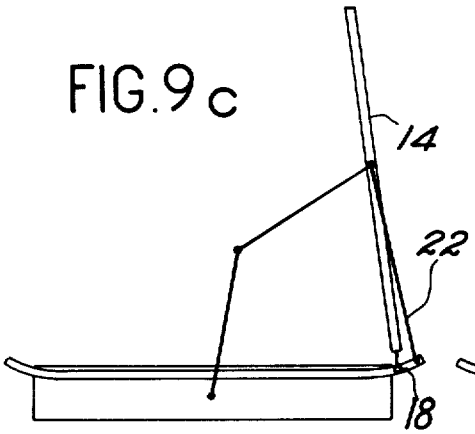

FIG. 9*a* represents the commencement of the opening movement in a normal bellows action: the rollers 18 are maintained in position by the locking-bolts within the curved portions 6 of the grooves 4. The arms 22 are in position alongside the window-leaf 14. FIG. 9*b* shows the window-leaf which is open at a wider angle. Starting from FIG. 9*c*, the locking-bolts are withdrawn and the rollers 18 leave the end portions 6 of the grooves 4.

Figure 9D:
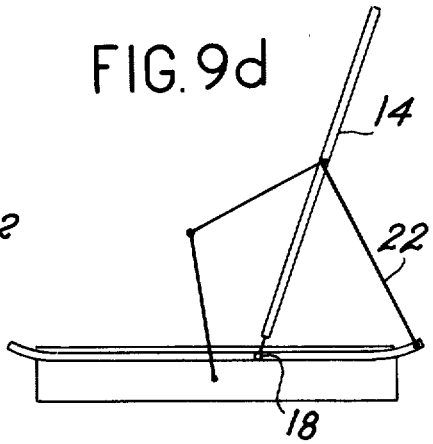
Figure 9E:
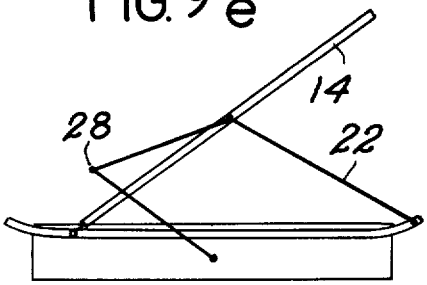
Figure 9F:
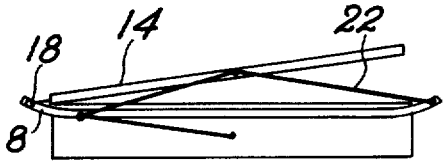

In FIG. 9*d*, the window-leaf 14 has passed beyond the vertical position (at right angles to the plane of the window-casing). This is the beginning of the movement of reversal. In FIGS. 9*e* and 9*f*, the movement of reversal continues until the rollers 18 arrive within the curved end portions 8. The "outer face" of the window-leaf is the directed towards the window-casing and cleaning of this face of the window-pane can readily be performed. In order to close the window again, the same operations are obviously carried out in the reverse order.

What we claim is:

1. A window having a fixed rectangular windowcasing and a rectangular window-leaf movable in bellows-like manner between open and closed positions and also being completely reversible relative to said window casing comprising:

leaf pivot means for forming a first axis of pivotal motion of said window-leaf with respect to said fixed window casing, said leaf pivot means being formed along a first side of said window-leaf, said first axis of pivotal motion being parallel to said first side and being movable in a direction parallel to itself;

a first arm pivotally secured by a first pivot means to a second side of said window-leaf which side is perpendicular to said first side;

a second arm pivotally secured by a second pivot means to a third side of said window-leaf which side is perpendicular to said first side;

said first and second pivot means defining a second axis of pivotal motion which permits complete reversal of said window-leaf;

said first and second arms being pivotally secured by third and fourth pivot means, respectively to opposite sides of said window casing near one end thereof;

said third and fourth pivot means defining a third axis of pivotal motion;

said second and third axes of pivotal motion being substantially parallel to said first axis of pivotal motion;

said third axis of pivotal motion substantially coinciding with said first axis of pivotal motion when the window is operated in bellows-like manner between open and closed positions;

said second and third axes of pivotal motion being maintained spaced apart by said first and second arms for a distance at least equal to one-half the length of the sides perpendicular to the first side; whereby complete reversal of said window-leaf may be achieved by rotation about said second axis of pivotal motion.

2. A window according to claim 1, wherein the leaf pivot means are constituted by two rollers, each roller being coupled to one of the consecutive corners of the window-leaf, both rollers being so arranged as to have a common axis which coincides with the first axis of pivotal motion and groove means defining two grooves which open in a direction away from the opening in the window casing and which extend at least the full length of the sides of the window-casing which are at right angles to the common axis of the two rollers, said rollers being constrained to move within said grooves.

3. A window according to claim 2, wherein said grooves are located on the external face of the window-casing and wherein aid grooves have a rectilinear portion located slightly beneath the plane of contact between the window-casing and the window-leaf when said window leaf is in the closed position, said rectilinear portion being intended to extend over a distance at least equal to the length of the window-leaf, each groove being formed so as to terminate in an upwardlycurved end portion so as to ensure that the rollers are located in said end portions in the plane of contact of the window-casing and the window-leaf when said leaf is closed.

4. A window according to claim 2 wherein each said groove is fitted with a retractable locking-bolt which is capable of securing the rollers against translational motion when said rollers take up the position corresponding to that of the closed window-leaf.

5. A window as claimed in claim 2 further comprising a first and a second supporting arm, each supporting arm being composed of two articulated arms having points of articulation and being pivotally secured to said window leaf by said first and second pivot means, respectively;

a fifth and sixth pivot means each being disposed below said grooves near the center of the sides in which the third and fourth pivot means are disposed, respectively; and said first and second supporting arms being pivotally secured to said fifth and sixth pivot means respectively.

6. A window according to claim 5, wherein the points of articulation of said articulated arms and said fifth and sixth pivot means each include elastic compensation devices.

7. A window according to claim 5, wherein the rods constituting each supporting arm have a length such that in the closed position the second axis of pivotal motion will have moved past dead center with respect to the supporting arms so that both said points of articulation will be above the second axis of pivotal motion whereby said rods will exert pressure urging the window-leaf against the windowcasing when said leaf is in the closed position.

8. A window according to claim 1, wherein said third and fourth pivot means include a straight rod disposed through said casing and being freely rotatable therein, the longitudinal axis of said rod coinciding with said third axis of pivotal motion, said rod including an elastic restoring device so arranged that one end of said device is attached to the window-casing and the other end thereof is attached to said rod; and a member operable for rotating said rod about its longitudinal axis.

9. A window having a fixed rectangular window-casing and a rectangular window-leaf movable in bellows-like manner between open and closed positions and also being completely reversable relative to said window casing comprising:

leaf pivot means for forming a first axis of pivotal motion of said window-leaf with respect to said fixed window casing, said leaf pivot means being formed along a first side of said window-leaf and including two rollers each coupled to one of the two consecutive corners of the window-leaf and both having a common axis which coincides with the first axis of pivotal motion said first axis of pivotal motion being parallel to said first side and being movable in a direction parallel to itself;

a first arm pivotally secured by a first pivot means to a second side of said window-leaf which side is perpendicular to said first side;

a second arm pivotally secured by a second pivot means to a third side of said window-leaf which side is perpendicular to said first side;

said first and second pivot means defining a second axis of pivotal motion which permits complete reversal of said window-leaf;

said first and second arms being pivotally secured by third and fourth pivot means, respectively to opposite sides of said window casing near one end thereof;

said third and fourth pivot means including a straight rod disposed through said casing and being freely rotatable therein, the longitudinal axis of said rod coinciding with said third axis of pivotal motion, said rod including an elastic restoring device so arranged that one end of said device is attached to the window casing and the other end thereof is attached to said rod; and a member operable for rotating said rod about its longitudinal axis;

said third and fourth pivot means defining a third axis of pivotal motion;

said second and third axes of pivotal motion being substantially parallel to said first axis of pivotal motion;

said third axis of pivotal motion substantially coinciding with said first axis of pivotal motion when the window is operated in bellows-like manner between open and closed positions;

said second and third axis of pivotal motion being maintained spaced apart by said first and second arms for a distance at least equal to one-half the length of the sides perpendicular to the first side; whereby complete reversal of said window-leaf may be achieved by rotation about said second axis of pivotal motion; and groove means defining two grooves extending over at least the full length of the windowcasing sides which are perpendicular to the common axis of the two rollers, said rollers being constrained to move within said grooves, and wherein said rod is provided at each end with an internal recess which is capable of receiving each roller, each recess being provided with an opening so as to permit the transfer of said roller from one of the grooves to the corresponding recess, the common axis of said recesses being such as to coincide with the longitudinal axis of said rod.

10. A window according to claim 9, wherein each said internal recess is fitted with a retractable locking-bolt for maintaining each roller within the corresponding recess.

11. A window according to claim 9, wherein the position of the rod when the window is in the closed position is such that the opening which permits the transfer of the roller establishes a communication between one of the grooves and the corresponding recess only when said rod has rotated through a predetermined angle.

* * * * *